US011412809B2

(12) United States Patent
Lai et al.

(10) Patent No.: US 11,412,809 B2
(45) Date of Patent: Aug. 16, 2022

(54) SEPARABLE AND RECYCLABLE FOOTWEAR

(71) Applicant: TBL Licensing LLC, Stratham, NH (US)

(72) Inventors: Chao Yun Lai, Taichung (TW); Alexander Dardinski, Newburyport, MA (US); Tadd Nicholas Smith, Rye, NH (US); David Hass, Dover, NH (US)

(73) Assignee: TBL Licensing LLC, Stratham, NH (US)

( * ) Notice: Subject to any disclaimer, the term of this patent is extended or adjusted under 35 U.S.C. 154(b) by 94 days.

(21) Appl. No.: 16/931,848

(22) Filed: Jul. 17, 2020

(65) Prior Publication Data

US 2021/0015202 A1 Jan. 21, 2021

Related U.S. Application Data

(60) Provisional application No. 62/875,090, filed on Jul. 17, 2019.

(51) Int. Cl.

| | |
|---|---|
| ***A43B 3/24*** | (2006.01) |
| ***A43B 1/10*** | (2006.01) |
| ***A43B 1/00*** | (2006.01) |

(52) U.S. Cl.

CPC ..... *A43B 3/248* (2013.01); *A43B 1/0063* (2013.01); *A43B 1/10* (2013.01); *A43B 3/244* (2013.01)

(58) Field of Classification Search

CPC ..... A43B 3/24; A43B 3/244; A43B 3/248; A43B 1/0063

USPC ..... 36/100, 101, 15

See application file for complete search history.

(56) References Cited

U.S. PATENT DOCUMENTS

| | | | | |
|---|---|---|---|---|
| 48,614 A | | 7/1865 | Ballou | |
| 1,228,720 A | * | 6/1917 | Troutt | A43B 5/08 36/8.1 |
| 1,714,271 A | | 5/1929 | Kelly | |
| 2,119,392 A | * | 5/1938 | Levin | A43B 3/24 36/12 |

(Continued)

FOREIGN PATENT DOCUMENTS

| | | |
|---|---|---|
| DE | 1675599 U | 4/1954 |
| EP | 0774216 A1 | 5/1997 |

(Continued)

OTHER PUBLICATIONS

International Search Report dated Sep. 17, 2020 for PCT Application No. PCT/US2020/042520; 16 pages.

*Primary Examiner* — Marie D Bays

(74) *Attorney, Agent, or Firm* — Smith, Gambrell & Russell LLP

(57) ABSTRACT

A separable footwear article may comprise an outsole oriented at the bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are capable of being separated by releasing the thread and hand pulling the thread from the footwear article.

18 Claims, 14 Drawing Sheets

(56) References Cited

U.S. PATENT DOCUMENTS

| | | | | |
|---|---|---|---|---|
| 2,438,711 | A * | 3/1948 | Leach | A43B 3/24 36/101 |
| 3,821,827 | A * | 7/1974 | Nadler | A43B 15/00 12/142 C |
| 4,156,947 | A * | 6/1979 | Nadler | A43B 9/00 12/142 R |
| 4,974,344 | A | 12/1990 | Ching | |
| 5,083,385 | A | 1/1992 | Halford | |
| 5,799,417 | A | 9/1998 | Burke et al. | |
| 6,023,857 | A | 2/2000 | Vizy | |
| 6,023,859 | A | 2/2000 | Burke et al. | |
| 6,467,116 | B1 * | 10/2002 | Strickland | A43B 13/39 12/142 D |
| 7,987,617 | B2 * | 8/2011 | Kohatsu | A43B 3/14 36/1 |
| 8,051,581 | B2 * | 11/2011 | Aveni | A43B 3/103 36/12 |
| 2005/0188562 | A1 * | 9/2005 | Clarke | A43B 23/0245 36/15 |
| 2009/0119950 | A1 * | 5/2009 | Kohatsu | A43D 999/00 36/103 |
| 2009/0313851 | A1 * | 12/2009 | Spinelli | A43B 3/24 36/15 |
| 2010/0088927 | A1 * | 4/2010 | Spinelli | A43B 13/36 36/101 |
| 2016/0331064 | A1 * | 11/2016 | Kawakami | A43B 13/14 |
| 2019/0116936 | A1 * | 4/2019 | Aceves Tinajero | A43B 23/0295 |
| 2019/0297988 | A1 * | 10/2019 | Oden | A43B 23/027 |
| 2020/0268100 | A1 * | 8/2020 | Bramani | A43B 3/244 |

FOREIGN PATENT DOCUMENTS

| | | | |
|---|---|---|---|
| EP | 1103197 | A2 | 5/2010 |
| FR | 1323629 | A | 4/1963 |
| GB | 484517 | A | 5/1938 |

* cited by examiner

SEPARABLE AND RECYCLABLE FOOTWEAR

CROSS REFERENCE TO RELATED APPLICATIONS

This application is a non-provisional of and claims the benefit of U.S. Provisional Application No. 62/875,090 filed Jul. 17, 2019, which is hereby incorporated by reference in its entirety.

FIELD OF THE DISCLOSURE

The present disclosure generally relates to the field of footwear, and more particularly to articles and methods relating to separable footwear.

BACKGROUND

Conventional articles of athletic footwear generally include at least two components, namely, an upper and a sole structure. The upper is often secured to the sole structure and forms a void on the interior of the footwear for securely and comfortably receiving a foot.

The upper and sole structure of most conventional articles of footwear are permanently secured together through adhesive bonding or stitching, for example.

Accordingly, wear or damage occurring to either the upper or sole structure may require that the entire article of footwear be discarded. In addition, sole structures are generally configured for use during specific activities, particularly with athletic footwear. For example, a sole structure may incorporate pronation control elements that are beneficial for running, stability elements for court-style activities, or relatively soft cushioning for walking. A sole structure that is configured for one athletic activity, such as long-distance running, may not be suitable for use during another athletic activity, such as tennis. Each different type of sole structure, therefore, may require a distinct upper in footwear where the upper and sole structure are permanently secured together.

In contrast with the conventional article of footwear that includes a permanently secured upper and sole structure, footwear configurations embodying an upper and detachable sole structure have been proposed. As an example, U.S. Pat. No. 6,023,857 to Vizy et al. discloses footwear with a permanently attached upper and outsole that includes a separate midsole and heel counter structure, which is removable from the upper. As another example, U.S. Pat. No. 5,083,385 to Halford and U.S. Pat. No. 4,974,344 to Ching both disclose an outsole structure that is detachable from the remainder of the footwear. As a further example, U.S. Pat. Nos. 6,023,859 and 5,799,417 to Burke et al. disclose an article of footwear with removable and exchangeable inserts that are positioned between the upper and a lower portion of the sole structure. The inserts protrude through the lower portion of the sole structure to provide a ground-contacting surface.

However, improvements are needed.

SUMMARY

A separable footwear article may comprise an outsole oriented at the bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are capable of being separated by releasing the thread and hand pulling the thread from the footwear article.

A separable footwear article may comprise: an outsole oriented at the bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are configured to be separated by releasing the thread and pulling the thread from the footwear article.

BRIEF DESCRIPTION OF THE DRAWINGS

The following drawings show generally, by way of example, but not by way of limitation, various examples discussed in the present disclosure. In the drawings.

DETAILED DESCRIPTION

The present disclosure relates to a separable footwear that may comprise a plurality of components coupled to one another, for example, using chain-stitching methods. The footwear may be disassembled with ease by undoing the chain-stitching coupling/holding the components together. One or more of the components of the footwear may comprise a recyclable material. Footwear may comprise a plurality of components made from the same recyclable material or from different recyclable materials that are coupled to one another with thread using chain-stitching methods. The footwear may be disassembled into its component parts. Disassembled components made from like materials may be sorted together and forwarded to a recycling plant or recycling center. Additionally or alternatively, disassembled components may be replaced with different components in a modular manner.

As an example, the components of the footwear may comprise laces, an upper portion, an insole, a midsole and an outsole. The upper portion may be oriented at the top of the assembled footwear and the outsole may be oriented at the bottom of the assembled footwear, and configured for ground contact. The insole may be located in-between the upper portion and the outsole and the midsole may be located in-between the insole and the outsole. The footwear may be assembled with additional components or without all of the listed components present. The components of the footwear may be made from the same material or from different materials. The components of the footwear may be made from the same recyclable material or from different recyclable materials. The components of the footwear may be coupled to one another with thread using chain-stitching or other sewing methods that can easily be disassembled.

Coupled components of the footwear may be disassembled by pulling out a loop of the chain-stitching that couples the components together, disengaging the thread from the footwear and applying force by tugging sharply on the thread until the coupled components are separated from one another. The method may be repeated to separate other components from one another. As an example, the outsole may be separated from the insole first and then the insole may be separated from the upper portion. The separated components may be sorted for recycling.

The components of the footwear may further comprise a plurality of segments. The segments may be coupled to one another with thread using chain-stitching or other sewing methods that can easily be disassembled. The segments of the components which are coupled together with thread using chain-stitching may further be disassembled into their individual parts. As an example, the upper portion of the footwear may comprise recyclable leather segments coupled together with thread using chain-stitching which may be disassembled into their individual leather segments and sorted for recycling.

Figure 1:
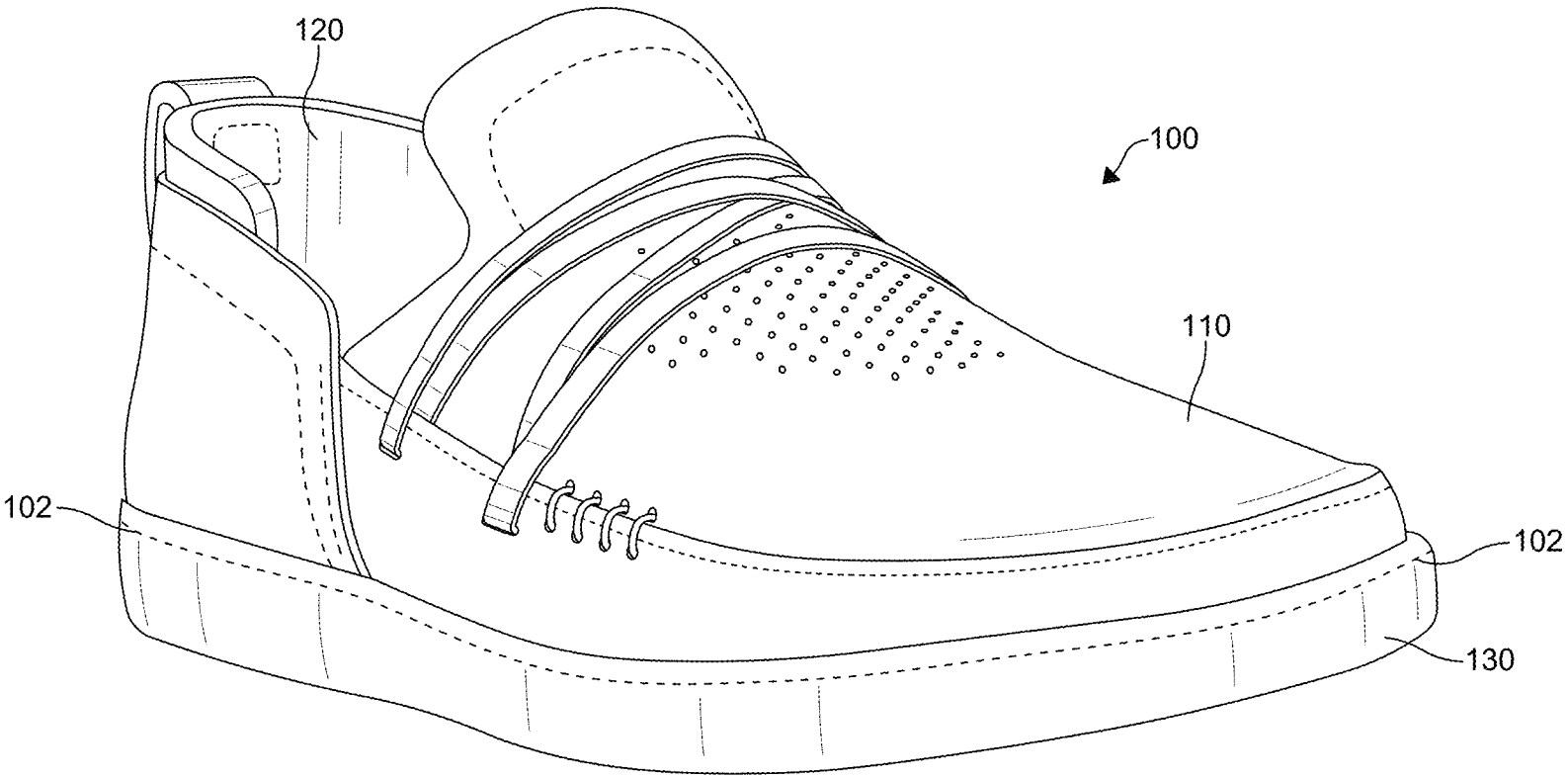
FIG. 1 is a perspective view of a separable and recyclable footwear in accordance with the present disclosure.
Figure 2A:
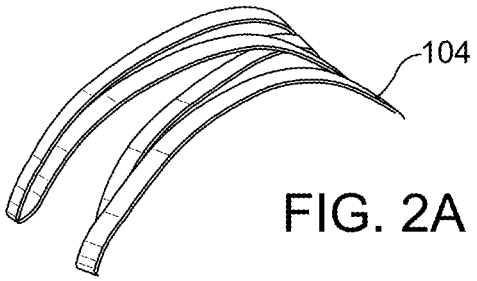
FIGS. 2A-2D illustrate the plurality of components of the separable and recyclable footwear of FIG. 1.
Figure 2B:
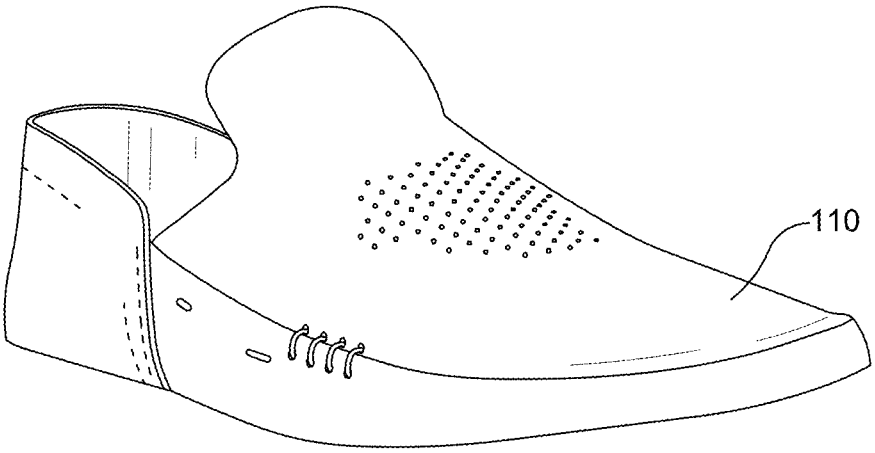
Figure 2C:
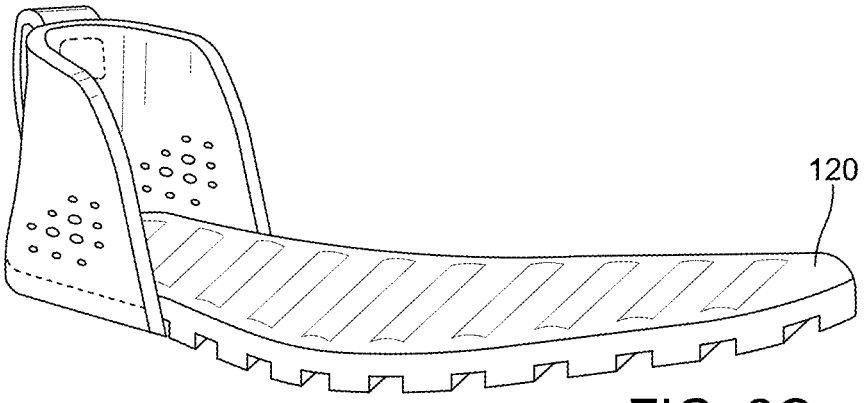
Figure 2D:
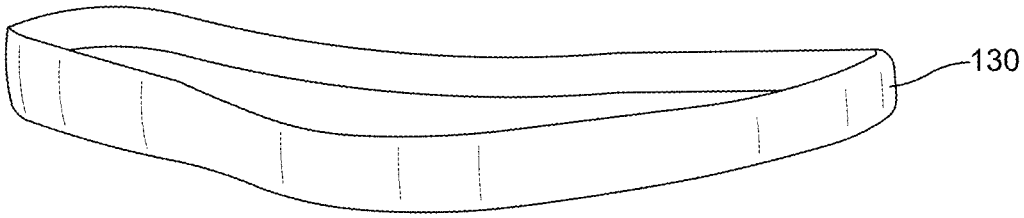

FIG. 1 shows an example separable and recyclable footwear 100 in accordance with the present disclosure. The components may be made from the same recyclable material or different recyclable materials. The components of the footwear 100 may be coupled together with thread using chain-stitching 102 to form at least a portion of the footwear 100.

As shown in FIGS. 1-2, the footwear 100 may comprise a plurality of separable components. The components of the footwear may be made from the same material or from different materials. The components may be made from the same type of recyclable material or different recyclable materials. The footwear 100 may comprise laces 104, an upper portion 110, an insole 120, and an outsole 130. The upper portion 110, insole 120 and the outsole 130 may be coupled together using chain-stitching methods to form footwear 100.

The upper portion 110 may be chain-stitched to the insole 120 and the insole may be chain-stitched to the outsole 130. The upper portion 110 may be oriented at the top of the footwear 100, the outsole 130 may be oriented at the bottom of the footwear 100, and the insole 120 may be located in-between the upper portion 110 and the outsole 130.

The laces 104 may be made from plastic such as recycled or recyclable polymers. The laces 104 may comprise or may be formed from cotton such as organic cotton or regenerative cotton. Other materials may be used. The upper portion 110 may be made from leather such as regenerative, recycled, or recyclable leather. The upper portion 110 may comprise or may be formed from polymer (e.g., polyethylene terephthalate PET) or cotton. Other materials may be used. The insole 120 may be made from wool such as biodegradable wool or merino wool. As an example, the insole 120 may have a foam base coupled to a wool heel. Other materials may be used. The outsole 130 may be made from recycled rubber or recycled plastic. The outsole 130 may comprise a foam portion coupled (e.g., stitched) to a rubber base. Other materials may be used.

The footwear 100 may further comprise other components. As an example, the footwear 100 may include a midsole between the insole 120 and the outsole 130. The midsole may be made from recyclable foam or other recyclable material(s).

Figure 3:
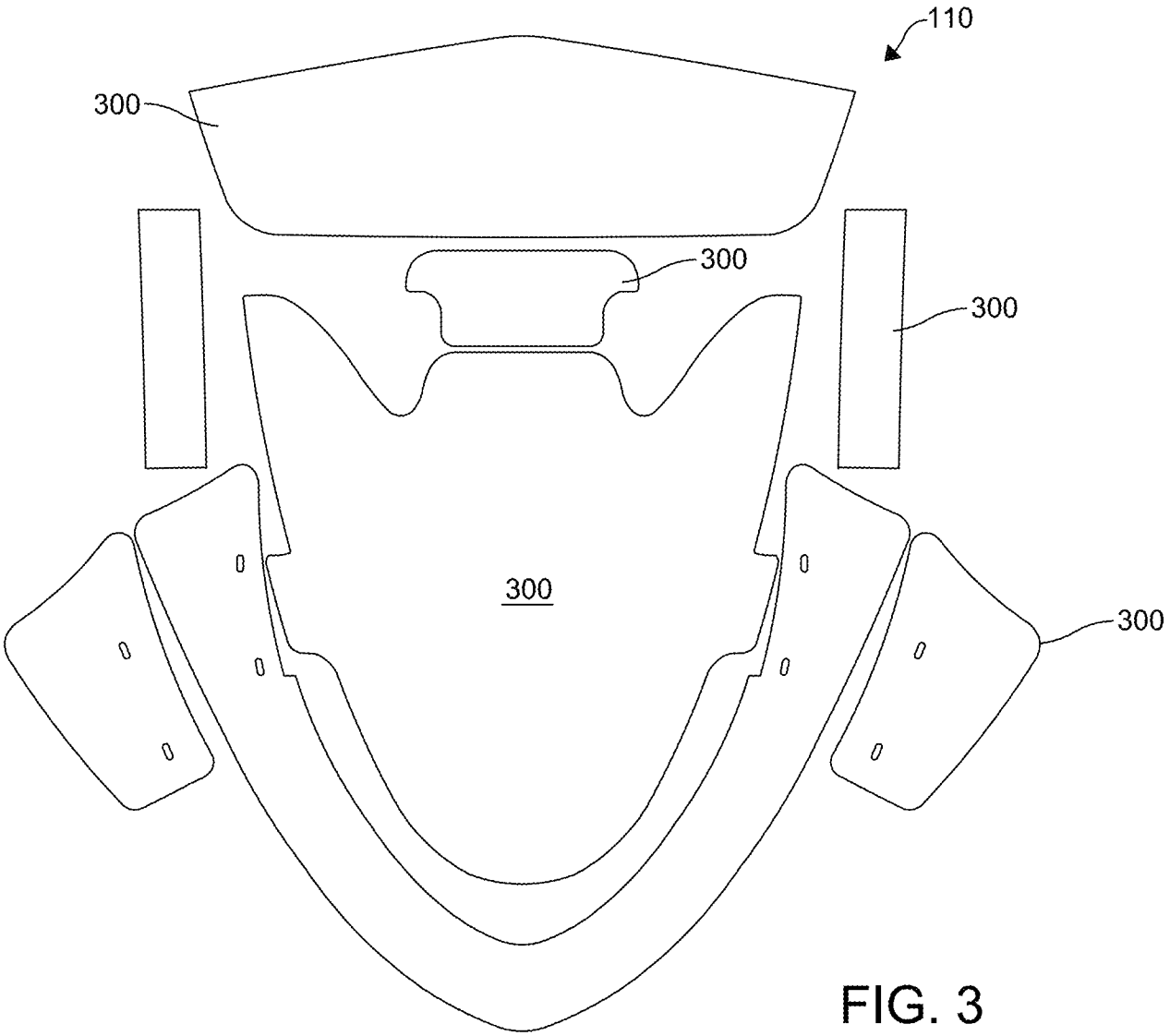
FIG. 3 is an exploded view of the plurality of segments of the upper portion of the separable and recyclable footwear of FIG. 1.

The separable components of the footwear 100 may further comprise a plurality of segments made from the same material or different materials. As an example, the upper portion 110 may comprise a plurality of separable segments (e.g., patterns) made from the same type of recyclable material or different types of recyclable materials (e.g. leather, PET, PET canvas). The upper portion 110 may comprise a plurality of segments made from the same type of recyclable leather or different types of recyclable leather. The plurality of separable segments of the upper portion 110 may be coupled together using chain-stitching methods. FIG. 3 shows an exploded view of the plurality of segments 300 of the upper portion 110 of the footwear 100. The segments 300 may be coupled together using chain-stitching methods or other methods. Alternatively, the upper portion 110 may be formed from a unitary piece (e.g., pattern) formed from the same material (e.g., recyclable materials described herein), such as illustrated in FIGS. 6A-6D. Such a unitary piece may undergo various flat operations prior to be formed (e.g., lasted) into a shape for coupling to an outsole (e.g., outsole 130).

Figure 4:
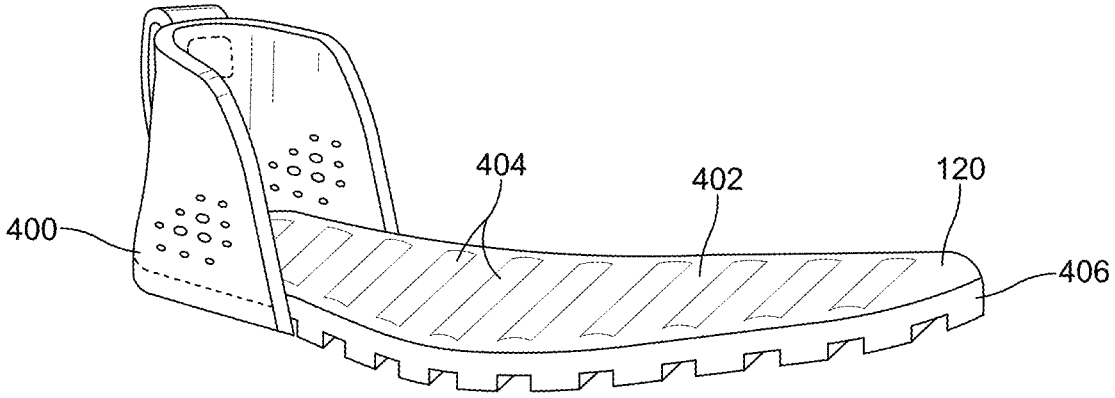
FIG. 4 illustrates an example insole in accordance with the present disclosure.

The insole 120 may further comprise a plurality of segments made from the same type of recyclable material or different types of recyclable materials. As an example, as shown in FIG. 4, the insole 120 may comprise a heel portion 400 and a base 406. The base 406 may further comprise an inner cushion 404 and an outer support 402. As an example, the heel 400 may be made from recyclable wool, the inner cushion 404 may be made from recyclable wool and the outer support 402 may be made from foam. The inner cushion 404 may have ridges and the outer support 402 may have grooves corresponding to the ridges of the inner cushion 404 in order to support the wearer's foot. As a further example, the base 406 may comprise a cover layer (not shown) that may be coupled to the upper, such as via stitching (e.g., chain stitching). The cover layer may be formed from various materials such as wool, for example.

Figure 5A:
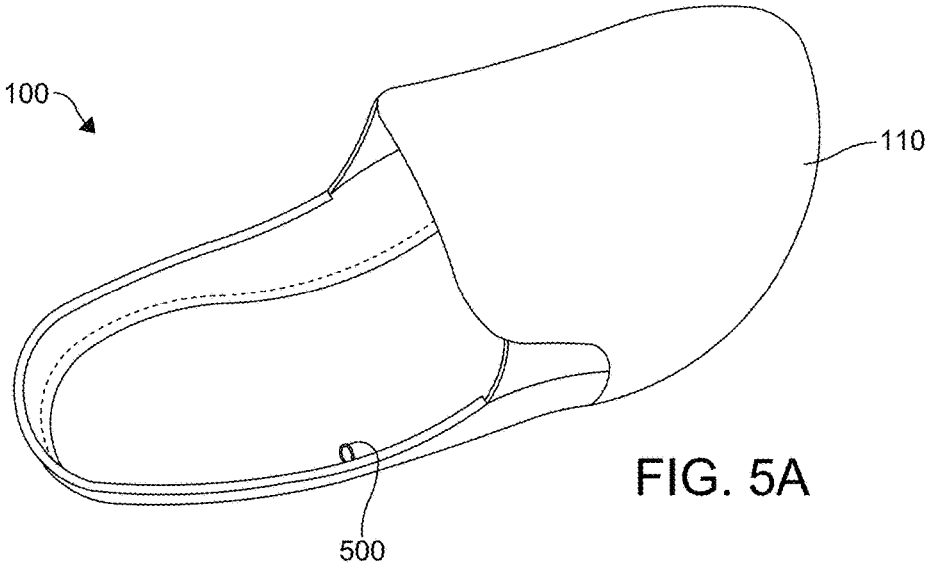
FIGS. 5A-5C illustrate a method of disassembling the separable and recyclable footwear of FIG. 1 in accordance with the present disclosure.
Figure 5B:
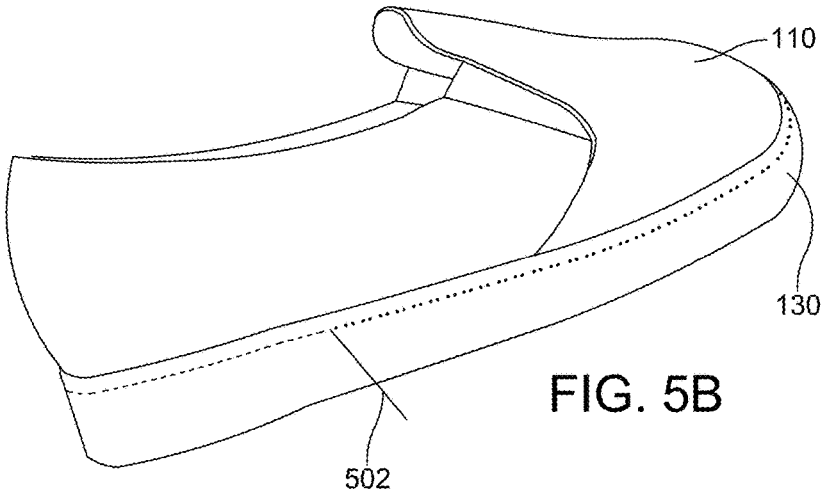
Figure 5C:
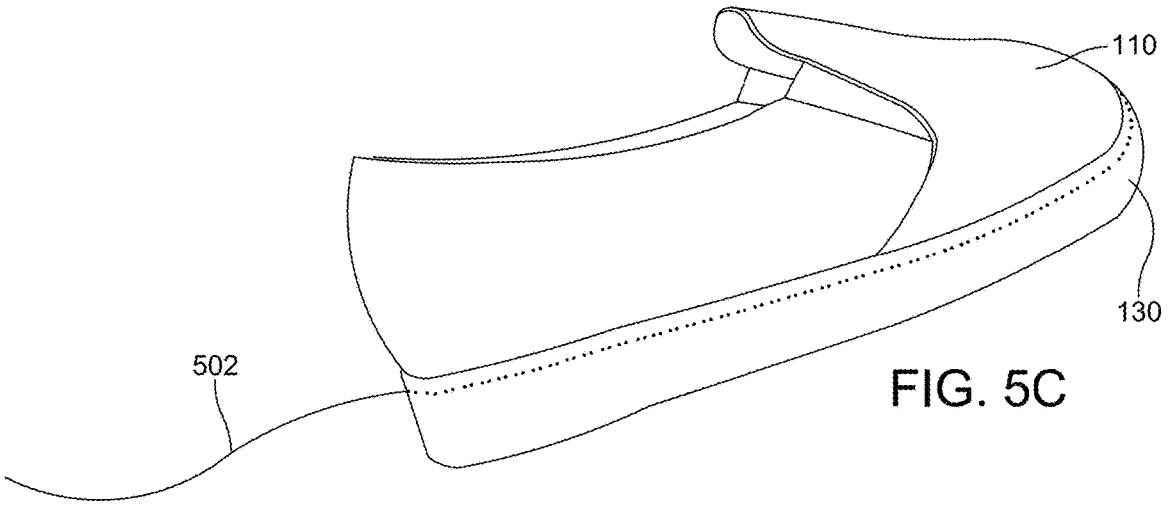
Figure 6A:
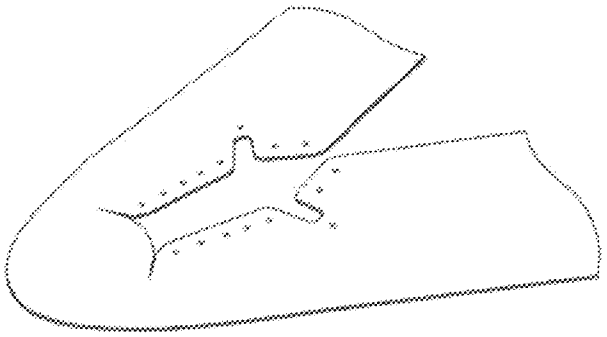
FIGS. 6A-6D illustrate example unitary patterns for a footwear upper.
Figure 6B:
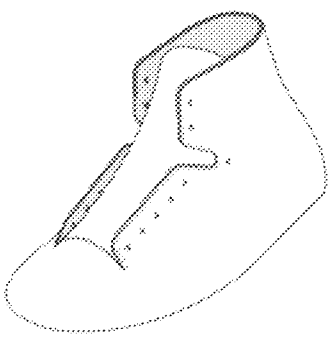
Figure 6C:
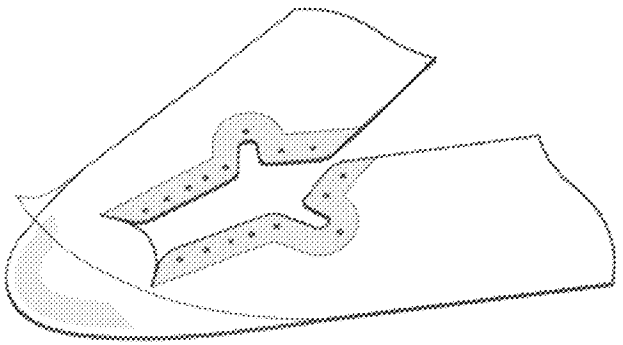
Figure 6D:
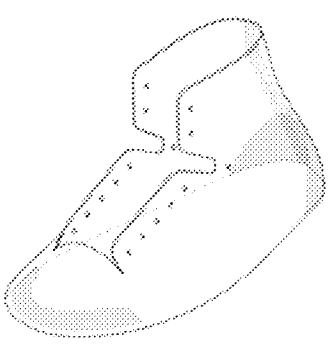

FIGS. 5A-5C illustrate a method of disassembling the footwear 100 in accordance with the present disclosure. FIG. 5A shows a loop of the chain-stitching that couples the outsole 130 to the upper portion 110 of the footwear. To disassemble the footwear 100, the loop of the chain-stitch 500 is pulled out/released, disengaging the thread 502 from the footwear 100 as shown in FIG. 5B. As used herein, releasing a thread may comprise loosening, cutting, or otherwise separating the thread from a stitched surface. Thereafter, force is applied to draw the thread 502 away from the footwear, separating the footwear 100 into its different components. In FIG. 5C, force is applied to draw out the thread 502 that couples the upper portion 110 to the outsole 130 of the footwear 100. Another loop of the chain-stitch thread 502 may be selected and the process repeated until the footwear is disassembled into its component parts. Like recyclable materials may be sorted together and sent to a recycling plant or center. The segments of the components may be further disassembled using the same method or similar methods.

Various chain-stitching machines may be used. As an example, a single thread chain-stitch seated type shoe border sewing machine (e.g., manufactured by Semlima) may be used.

Various stitch patterns may be used. As an example, 4-5 stitches may be used per inch. As an illustrative example, overlapping stitches (e.g., 6, 5, 3, etc.) may be used on at least the stitching start and ending area. Such overlapping stitching may improve the coupling strength on the subject area. Alternatively or additionally, after the stitching of the upper to the outsole is complete, an end of the stitching thread may be cut. The end (cut or uncut) may be inserted into a stitch hole (e.g., an adjacent stitch hole). An adhesive, such as glue may be disposed (e.g., injected) at the stitch hole to fix the end of the thread in place. Alternatively or additionally, an end of the thread may extend toward in inside of area of the footwear, where an insole may be disposed. As such, the end of the thread on the inside may be sealed in position, for example, using a hot melt and a stamp over the thread to secure the thread to the inside of the footwear.

Various threads for stitching may be used. As an example, 1.0 mm polyester braid may be used.

Various components such as the upper and the sole may be temporarily coupled to hold a position for stitching. As an example, a temporary cement (e.g., yellow glue code 766N by Nanpao) may be used to temporarily couple components.

Figure 7C:
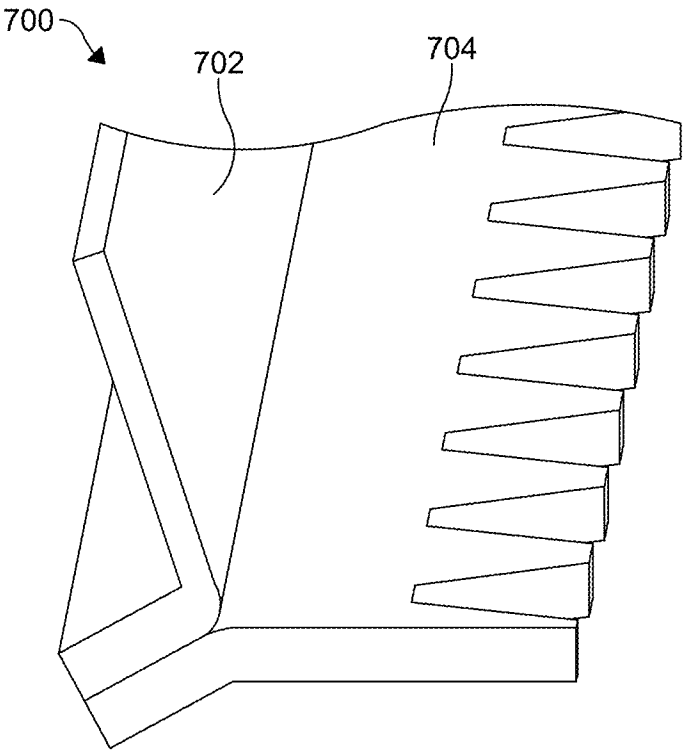
FIGS. 7A-7C illustrate an example welt in accordance with the present disclosure.
Figure 7B:
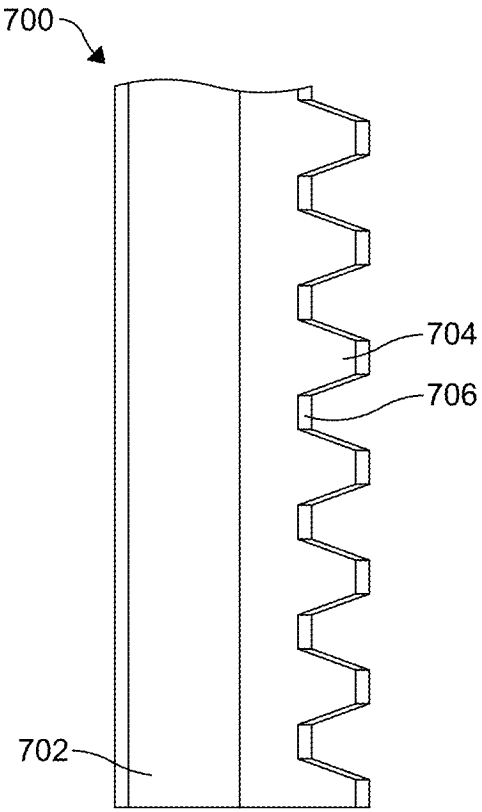
Figure 7A:
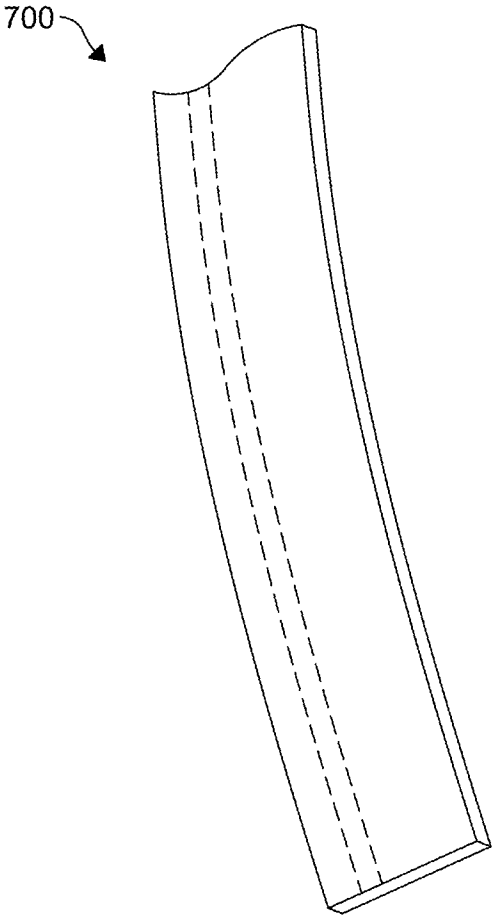

Additionally or alternatively, articles and/or methods in accordance with the present disclosure may comprise a welt 700, for example, as illustrated in FIGS. 7A-7C. The welt 700 may be formed from various materials including leather, recyclable leather, and/or other recyclable materials. As shown, the welt 700 may be split from a center or near a center to define a generally Y-shaped cross section. As such, one branch 702 may be coupled (e.g., chain stitched) to an upper and the other branch 704 may be coupled (e.g., chain stitched) to an outsole. As shown, at least one of the branches 702, 704 may comprise notches 706 or indentations to provide freedom of movement.

Figure 8:
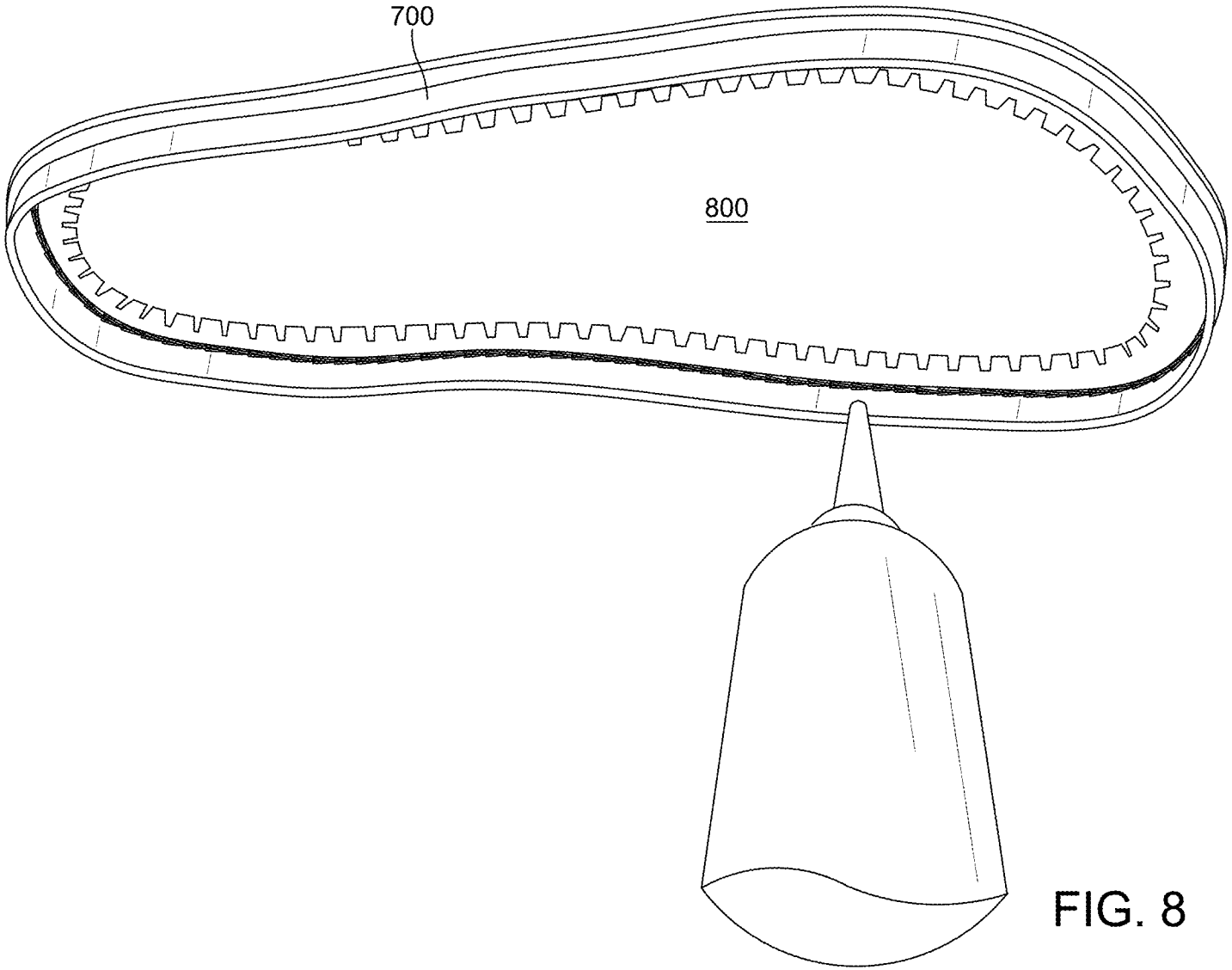
FIG. 8 illustrates an example method in accordance with the present disclosure.
Figure 9:
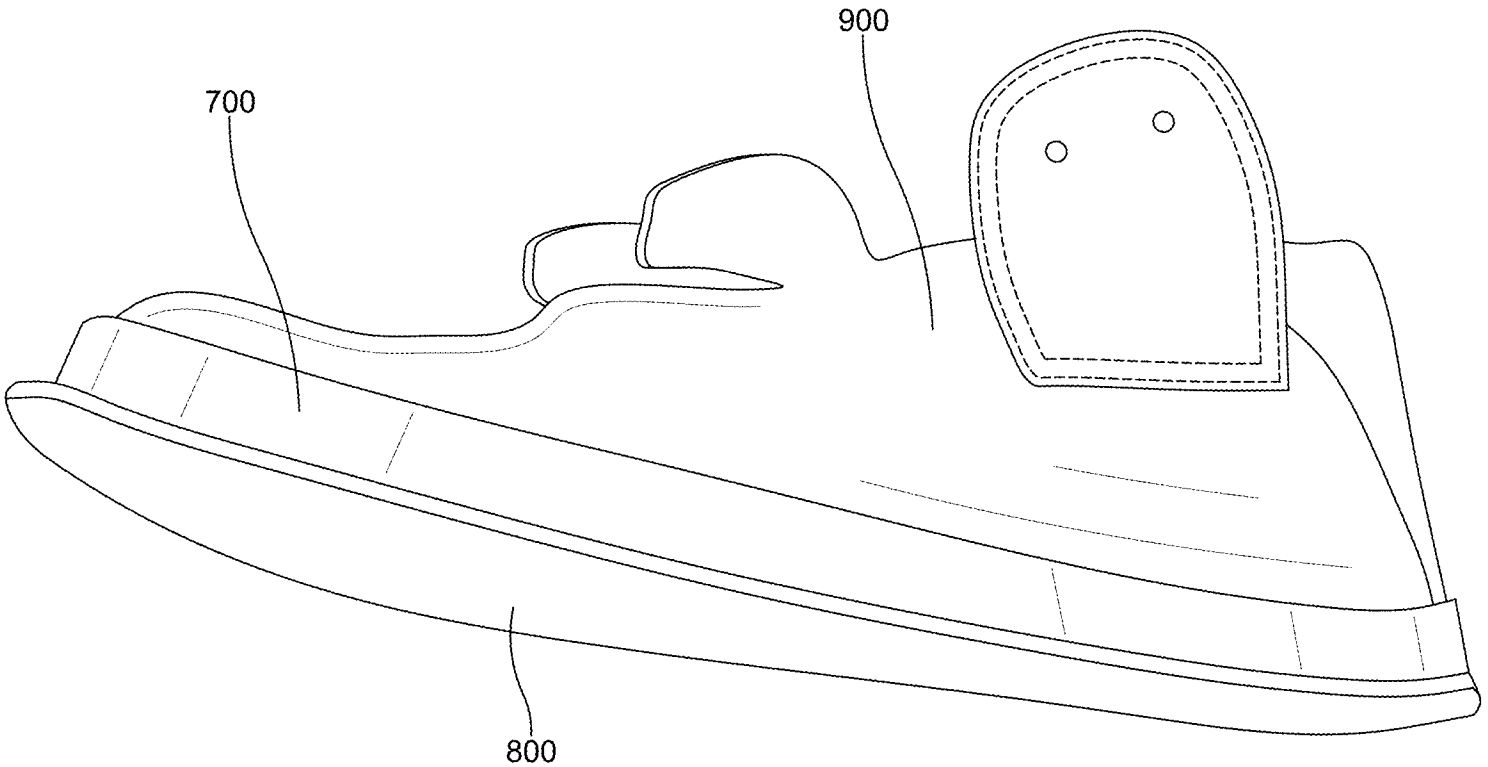
FIG. 9 illustrates an example method in accordance with the present disclosure.

A method in accordance with the present disclosure may comprise a method of making footwear that is configured to disassembly, for example, to be recycled into component parts. The method may comprise applying a temporary adhesive to at least a portion of the welt 700 and coupling the welt 700 to an outsole 800, as shown in FIG. 8. The method may comprise applying a temporary adhesive to at least a portion of the welt 700 and coupling the welt 700 to an upper 900, as shown in FIG. 9. As illustrated in FIG. 9, the welt 700 may be coupled to the outsole 800 and while coupled to the outsole 800, may be coupled to the upper 900. Other process steps and ordering of steps may be used.

Figure 10:
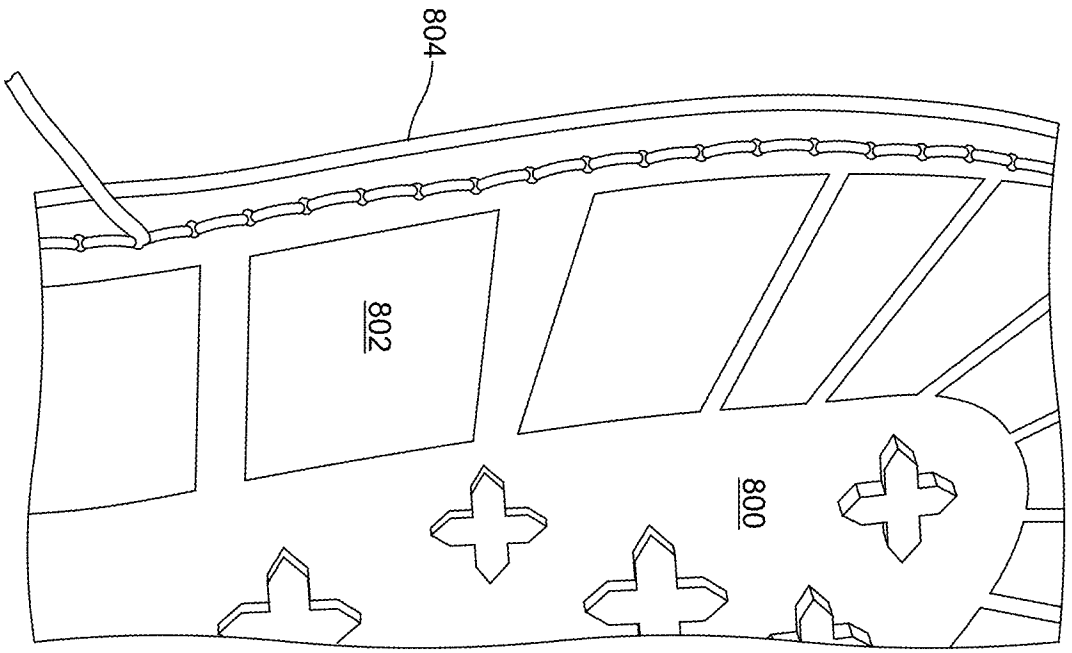
FIG. 10 illustrates an example method in accordance with the present disclosure.

FIG. 10 illustrates chain stitching of the welt 700 and the outsole 800. The welt 700 and the outsole 800 may first be temporarily coupled using an adhesive to hold a position for stitching. However, other steps or process including not using temporary adhesive may be used. As shown, the stitching may be through a bottom surface 802 of the outsole 800 and may be disposed adjacent a peripheral edge 804 of the outsole 800.

Figure 11A:
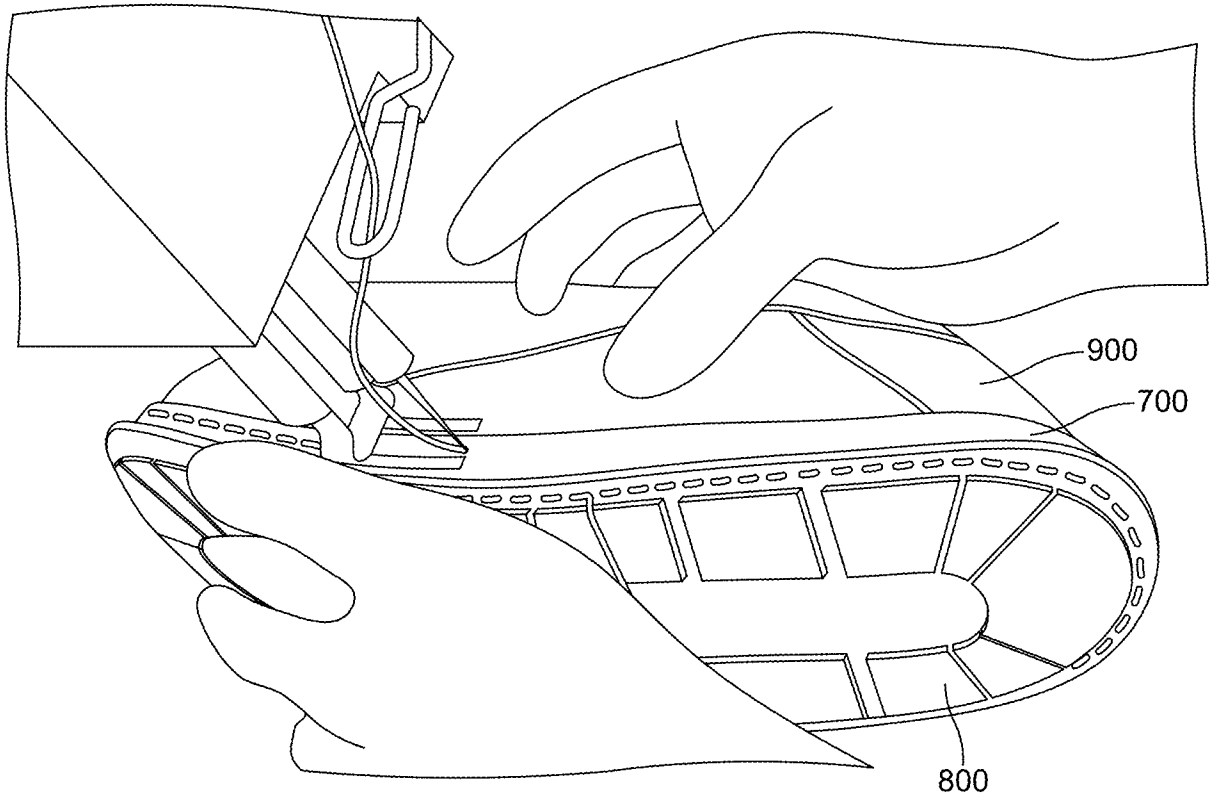
FIGS. 11A-11C illustrate an example method in accordance with the present disclosure.
Figure 11C:
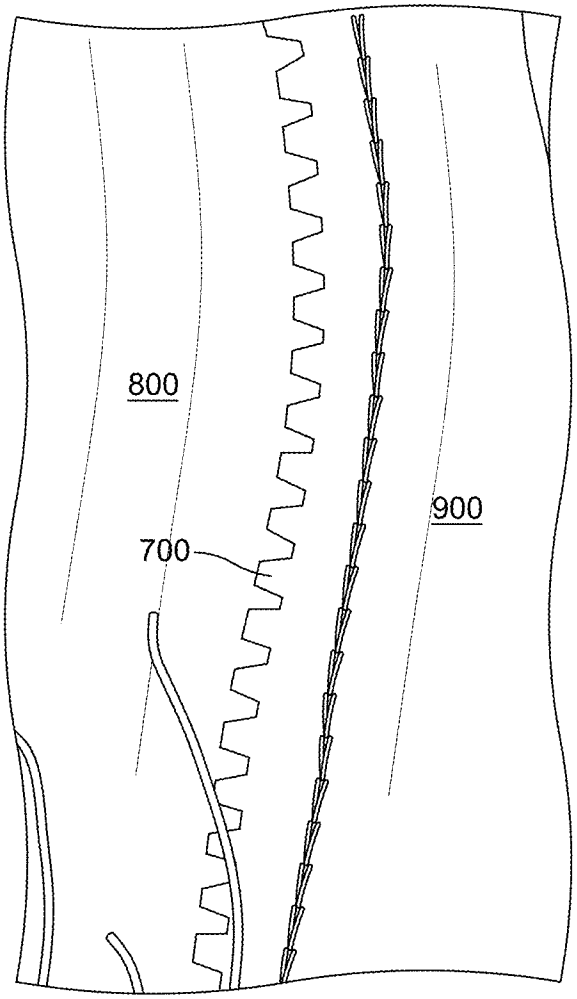
Figure 11B:
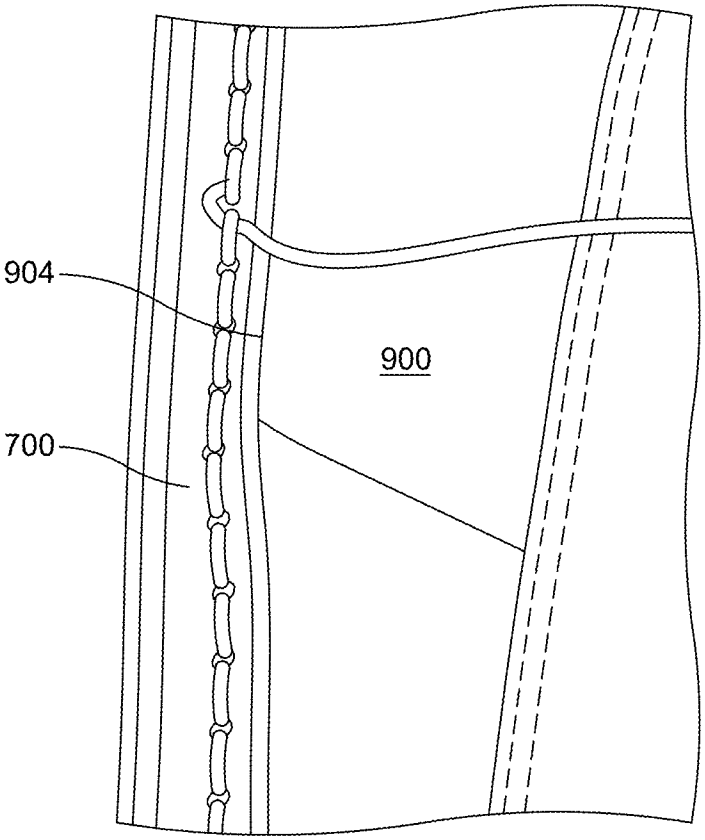

FIGS. 11A-11B illustrate chain stitching of the welt 700 and the upper 900. The welt 700 and the upper 800 may first be temporarily coupled using an adhesive to hold a position for stitching. However, other steps or process including not using temporary adhesive may be used. As shown, the stitching may be disposed adjacent a peripheral edge 904 of the upper 900.

Figure 12:
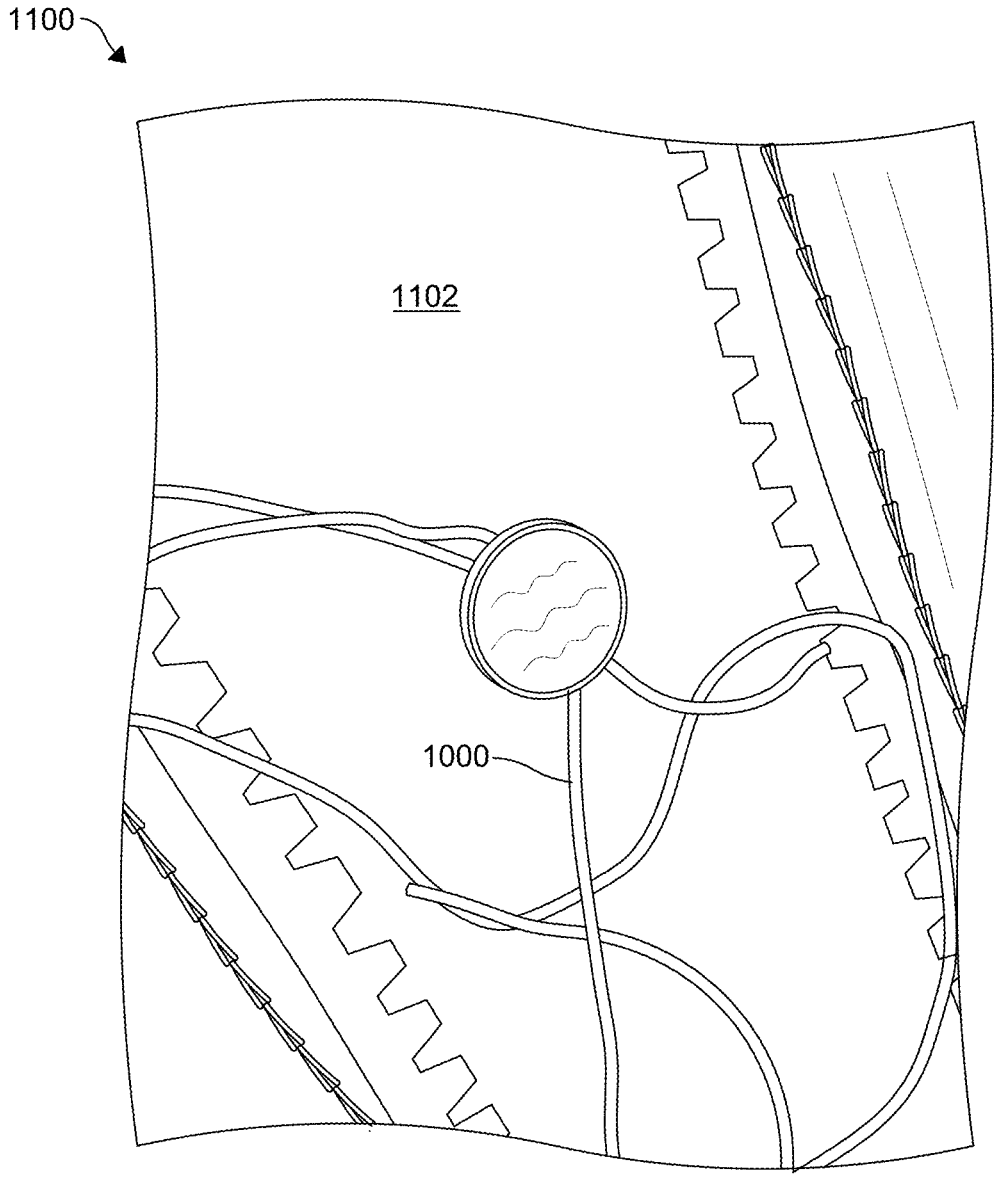
FIG. 12 illustrates an example method in accordance with the present disclosure.
Figure 13:
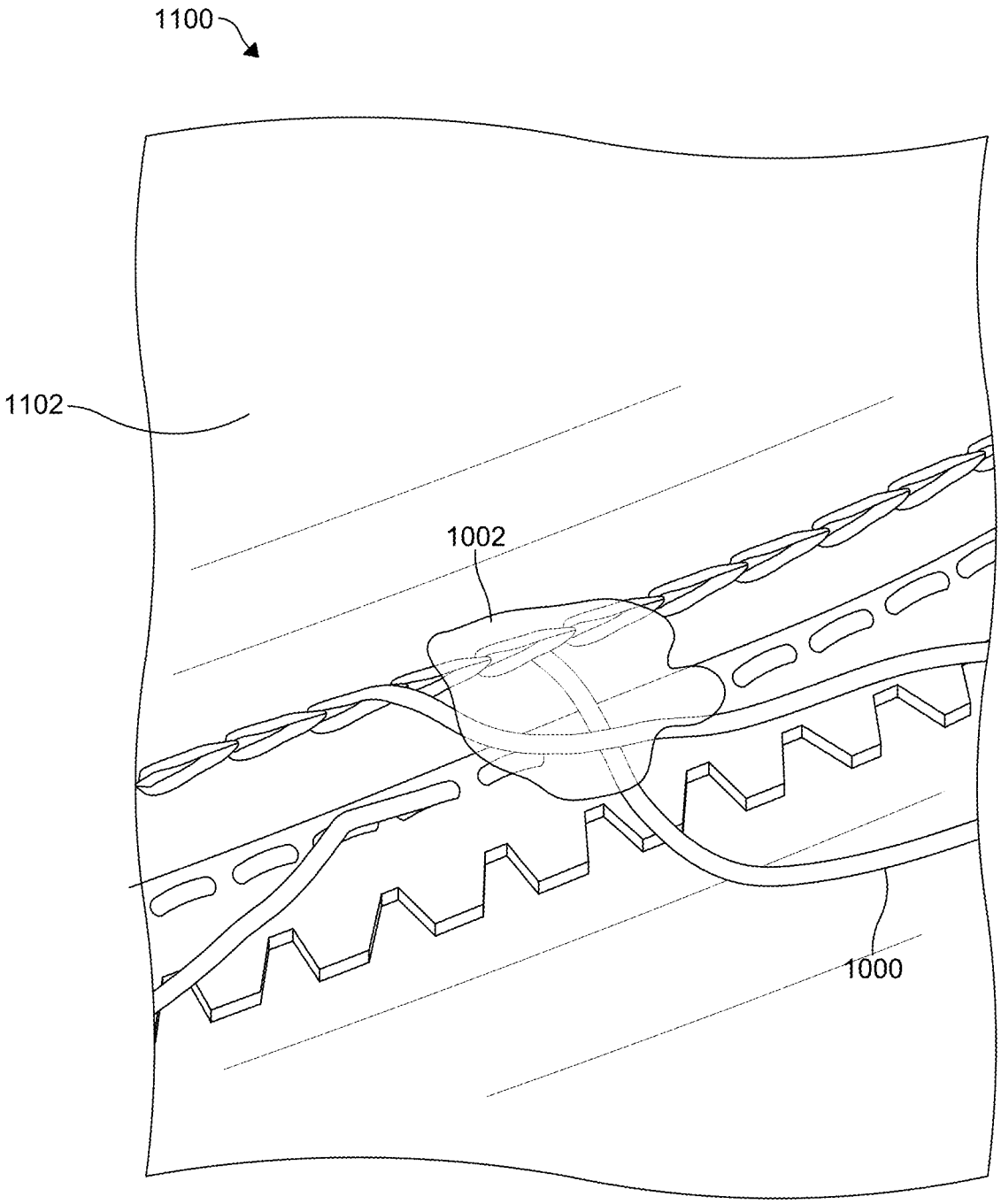
FIG. 13 illustrates an example method in accordance with the present disclosure.

Ends of the thread used for chain stitching may be disposed on an outside of the upper 900 when the stitching is initially complete. As shown in FIG. 12, thread 1000 (e.g., thread ends, thread ends pulled from the outside of the upper 900) may be disposed in an interior of the footwear 1100. The threads 1000 may be secured to an interior surface 1102 of the footwear such as an upper side of the outsole 800. Other surfaces may be used. As shown, the threads 1000 may be secured using a wax or other hot melt material. Such a wax may be stamped to further secure the threads and/or to provide ornamental marking. Wax or other materials may be used to seal any stitching hole and/or thread ends 1002, as shown in FIG. 13.

For disassembly of the footwear 1100, the thread ends 1002 may be removed from the seal (e.g., wax) and pulled outside of the footwear 1100. The stitching may be removed from the upper 900 and welt 700 to release the upper 900, for example, by simply pulling the thread 1000 to release the chain stitches. The stitching may be removed from the outsole 800 and welt 700 to release the outsole 800, for example, by simply pulling the thread 1000 to release the chain stitches. The upper 900, outsole 800, and welt 700 may be pulled apart for recycling. It is understood that some adhesion of the components may be evident based on the temporary adhesive. However, the nature of the temporary adhesive allows for pulling apart of the components by hand.

The present disclosure comprises at least the following aspects:

Aspect 1: A separable footwear article comprising: an outsole oriented at a bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are capable of being separated by releasing the thread and hand pulling the thread from the footwear article.

Aspect 2: The separable footwear article of aspect 1, wherein the first material comprises recyclable rubber.

Aspect 3: The separable footwear article of any of aspects 1-2, wherein the first material comprises recyclable polymer.

Aspect 4: The separable footwear article of any of aspects 1-3, wherein the second material comprises leather.

Aspect 5: The separable footwear article of any of aspects 1-4, wherein the third material comprises wool.

Aspect 6: The separable footwear article of any of aspects 1-5, wherein the insole comprises a heel portion and a base portion.

Aspect 7: The separable footwear article of aspect 6, wherein the base portion comprises an inner cushion and an outer support.

Aspect 8: A method of making the separable footwear article of any of aspects 1-7.

Aspect 9: A method of recycling the separable footwear article of any of aspects 1-7, the method comprising: separating the insole from the outsole and the upper portion; releasing the thread; and applying a force to the thread to disengage the thread from the outsole and the upper, thereby separating the outsole from the upper.

Aspect 10: A separable footwear article comprising: an outsole oriented at a bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are configured to be separated by releasing the thread and pulling the thread from the footwear article.

Aspect 11: The separable footwear article of aspect 10, wherein the first material comprises recyclable rubber.

Aspect 12: The separable footwear article of any of aspects 10-11, wherein the first material comprises recyclable polymer.

Aspect 13: The separable footwear article of any of aspects 10-12, wherein the second material comprises leather.

Aspect 14: The separable footwear article of any of aspects 10-13, wherein the third material comprises wool.

Aspect 15: The separable footwear article of any of aspects 10-14, wherein the insole comprises a heel portion and a base portion.

Aspect 16: The separable footwear article of aspect 15, wherein the base portion comprises an inner cushion and an outer support.

Aspect 17: A method of making the separable footwear article of any of aspects 10-16.

Aspect 18: A method of recycling the separable footwear article of any of aspects 10-16, the method comprising: separating the insole from the outsole and the upper portion; releasing the thread; and applying a force to the thread to disengage the thread from the outsole and the upper, thereby separating the outsole from the upper.

Aspect 19: A separable footwear article comprising: an outsole oriented at a bottom of the footwear and configured for ground contact, the outsole comprising a first material; and an upper portion releasably coupled to the outsole via a coupling mechanism, the upper portion comprising a second material different from the first material; wherein the outsole and the upper portion are capable of being separated by releasing the coupling mechanism.

Aspect 20: The separable footwear article of aspect 19, wherein the coupling mechanism is capable of being released by hand.

Aspect 21: The separable footwear article of any one of aspects 19-20, wherein the coupling mechanism comprises a chain stitch or snaps.

Aspect 22: The separable footwear article of aspect 19, wherein the first material comprises recyclable rubber.

Aspect 23: The separable footwear article of any of aspects 19-22, wherein the first material comprises recyclable polymer.

Aspect 24: The separable footwear article of any of aspects 19-23, wherein the second material comprises leather.

Aspect 25: A method of making the separable footwear article of any of aspects 19-24.

What is claimed is:

1. A separable footwear article comprising:

an outsole oriented to define a bottom of a footwear article and configured for ground contact, the outsole comprising a first material;

an upper portion the upper portion comprising a second material different from the first material;

a welt configured to releasably join the outsole and the upper, wherein the welt is releasably coupled to the outsole and the upper portion via thread, wherein the welt is split from a center to define a Y-shaped cross section, and wherein a first branch of the welt is releasably coupled to the upper and a second branch of the welt is releasably coupled to the outsole with thread using chain stitching; and an insole removeably disposed adjacent the upper portion and the outsole, the insole comprising a third material different from the first material and the second material;

wherein the outsole, the upper portion, and the welt are configured to be separated upon receipt of a pulling force upon the thread sufficient to remove the thread from the footwear article.

2. The separable footwear article of claim 1, wherein the first material comprises recyclable rubber.

3. The separable footwear article of claim 1, wherein the first material comprises recyclable polymer.

4. The separable footwear article of claim 1, wherein the second material comprises leather.

5. The separable footwear article of claim 1, wherein the third material comprises wool.

6. The separable footwear article of claim 1, wherein the insole comprises a heel portion and a base portion.

7. The separable footwear article of claim 6, wherein the base portion comprises an inner cushion and an outer support.

8. The separable footwear article of claim 1, wherein the outsole, the upper portion and the welt are releasably coupled using a temporary adhesive and chain stitching.

9. A method of making a separable footwear article comprising:

providing an outsole oriented to define a bottom of a footwear article and configured for ground contact, the outsole comprising a first material;

providing an upper portion, the upper portion comprising a second material different from the first material;

providing a welt configured to releasably join the outsole and the upper, wherein the welt is split from a center to define a Y-shaped cross section;

temporarily coupling to the outsole, the upper portion and the welt via a temporary adhesive to hold a stitching position prior to coupling the outsole, the upper portion, and the welt;

releasably coupling the upper portion to a first branch of the welt via a thread using chain stitching;

releasably coupling the outsole to a second branch of the welt via a thread using chain stitching wherein the welt releasably coupled to the outsole and the upper portion via the thread, wherein the outsole, the upper portion, and the welt are configured to be separated upon receipt of a pulling force upon the thread sufficient to remove the thread from the footwear article.

10. The method of claim 9, further comprising:

providing an insole removeably disposed adjacent the upper portion and the outsole, the insole comprising a third material different from the first material and the second material.

11. The method of claim 9, further comprising:

providing a welt configured to releasably join the outsole and the upper portion to form the footwear, wherein the welt is split from a center to define a Y-shaped cross section comprising a first branch and a second branch.

12. The method of claim 11, further comprising:

temporarily adhering the outsole to the first branch of the welt; and temporarily adhering the upper portion to a second branch of the welt.

13. The method of claim 12, further comprising:

releasably coupling the outsole to a first branch of the welt; and releasably coupling the upper portion and a second branch of the welt.

14. A separable footwear article comprising:

an outsole configured to be oriented at a bottom of a footwear and configured for ground contact, the outsole comprising a first material; and an upper portion, the upper portion comprising a second material different from the first material;

a welt configured to releasably join the outsole and the upper, wherein the welt is releasably coupled to the outsole and the upper portion via a coupling mechanism, wherein the welt is split from a center to define a Y-shaped cross section, and wherein a first branch of the welt is releasably coupled to the upper and a second branch of the welt is releasably coupled to the outsole via the coupling mechanism;

wherein the outsole, the upper portion, and the welt are capable of being separated by releasing the coupling mechanism.

15. The separable footwear article of claim 14, wherein the coupling mechanism is configured to be removed from the separable footwear upon receipt of a pulling force upon the coupling mechanism sufficient to separate the coupling mechanism from the separable footwear.

16. The separable footwear article of claim 14, wherein the coupling mechanism comprises a chain stitch or snaps.

17. The separable footwear article of claim 14, wherein the first material comprises recyclable rubber or recyclable polymer.

18. The separable footwear article of claim 14, wherein the second material comprises leather.

* * * * *